US005138725A

United States Patent [19]

Fernstrum, Jr.

[11] Patent Number: 5,138,725

[45] Date of Patent: Aug. 18, 1992

[54] TRAVEL LIMITING FLAPPER VALVE MOUNTING ADAPTER

[75] Inventor: John A. Fernstrum, Jr., Phoenix, Ariz.

[73] Assignee: Frugal Fellows Limited Partnership, Phoenix, Ariz.

[21] Appl. No.: 549,208

[22] Filed: Jul. 6, 1990

Related U.S. Application Data

[63] Continuation-in-part of Ser. No. 515,861, Apr. 27, 1990.

[51] Int. Cl.[5] ..... E03D 1/35

[52] U.S. Cl. ..... 4/393

[58] Field of Search ..... 4/392, 393, 403, 404

[56] References Cited

U.S. PATENT DOCUMENTS

| | | | |
|---|---|---|---|
| D. 248,313 | 6/1978 | Henry | D23/1 |
| D. 248,404 | 7/1978 | Henry | D23/1 |
| 1,233,684 | 7/1917 | Meyer et al. . | |
| 2,883,675 | 4/1959 | Hartman . | |
| 3,167,787 | 2/1965 | Connealy . | |
| 3,324,482 | 6/1967 | Wustner . | |
| 3,331,084 | 7/1967 | Wustner . | |
| 3,590,395 | 7/1971 | Wustner . | |
| 3,599,247 | 8/1971 | Kamphausen | 4/393 |
| 3,702,012 | 11/1972 | Bennett | 4/392 |
| 3,707,733 | 1/1973 | Gore et al. | 4/393 |
| 3,812,545 | 5/1974 | Lanahan . | |
| 3,858,250 | 1/1975 | Coglitore . | |
| 3,955,218 | 5/1976 | Ramsey . | |
| 4,000,526 | 1/1977 | Bieia et al. . | |
| 4,149,283 | 4/1979 | Knudtson | 4/324 |
| 4,160,294 | 7/1979 | Crumby | 4/393 |
| 4,189,795 | 2/1980 | Conti et al. | 4/324 |
| 4,497,076 | 2/1985 | Sullivan | 4/392 |
| 4,698,859 | 10/1987 | Freed | 4/393 |

*Primary Examiner*—Charles E. Phillips
*Attorney, Agent, or Firm*—Gregory J. Nelson

[57] ABSTRACT

An adapter for mounting and limiting the pivotal movement of a flapper valve upon a pair of uprights extending from a valve seat of a discharge pipe in a toilet tank.

20 Claims, 1 Drawing Sheet

TRAVEL LIMITING FLAPPER VALVE MOUNTING ADAPTER

CROSS REFERENCE TO RELATED APPLICATIONS

This application is a continuation in part application of a copending application entitled "FLAPPER VALVE MOUNTING ADAPTER", filed on Apr. 27, 1990 and assigned Ser. No. 515,861.

BACKGROUND OF THE INVENTION

1. Field of the Invention

The present invention relates to mountings for toilet tank flapper valves and, more particularly, to an adapter for pivotally supporting a replacement flapper valve.

2. Description of the Prior Art

For years, a number of companies have provided ball valves or flapper valves for use in toilet tanks to control water flow into the discharge pipe. These flapper valves are usually pivotally mounted upon a stand pipe having pins or trunnions extending therefrom. A secondary market exists for providing replacement flapper valves which are other than the original equipment supplied by the original source or manufacturer. These flapper valves, which may have many different configurations, have arms extending therefrom for pivotally engaging stand pipe mounted pins or trunnions.

In certain installations, the stand pipe does not include pins or trunnions for mounting a flapper valve. To meet this contingency, collar like devices have been developed for circumscribingly engaging the stand pipe. These collars include the pins or trunnions for mounting replacement flapper valves.

American Standard, a major supplier of original equipment for use in toilet tanks, has developed a specially configured valve assembly for controlling water outflow through the discharge pipe. This assembly is mounted on or in conjunction with the upper end of the discharge pipe within the toilet tank. The assembly includes a conventional stand pipe attached to a ring serving as a valve seat in alignment with the discharge outlet. A pair of uprights extend upwardly from the ring to support the ball or flapper valve. These uprights are sufficiently close to the valve seat to preclude effective use of most after market replacement flapper valves which might be mountable upon the stand pipe. Accordingly, replacements for the flapper valve and its related structure must be obtained from American Standard. Because after market flapper valves cannot be used effectively and as the source of replacement parts is exclusive with the manufacture, the costs attendant replacement/repair are relatively high.

SUMMARY OF THE INVENTION

An adapter includes a pair of slots for receiving a correspondingly sized pair of uprights extending from a valve seat attendant the discharge outlet in a toilet tank. The adapter penetrably receives the uprights and is firmly held in place by them. A pair of trunnions extend in opposed directions from opposed sides of the adapter to receive, retain and pivotally support apertured arms of a replacement flapper valve. A brace extends upwardly from the body of the adapter to preclude the flapper valve from pivoting upwardly past vertical.

It is therefore a primary object of the present invention to provide an adapter for pivotally mounting a flapper valve.

Another object of the present invention is to provide an adapter for a particular environment to pivotally mount a flapper valve.

Yet another object of the present invention is to provide a mounting for replacement flapper valves adapted for seating upon any of a family of paired uprights.

Still another object of the present invention is to provide an adapter for mounting a flapper valve upon a pair of uprights extending from a location adjacent the valve seat of a toilet tank drain while preventing the flapper valve from pivoting upwardly past vertical.

A further object of the present invention is to provide an adapter for a replacement flapper valve attachable to the ball valve mounting of an American Standard ball valve toilet tank assembly which precludes the flapper valve from pivoting upwardly past vertical.

A yet further object of the present invention is to provide a pair of flapper valve supporting trunnions mounted upon the uprights of a ball valve supporting assembly.

A still further object of the present invention is to provide an adapter for mounting a flapper valve upon an American Standard ball valve seat in a toilet tank and for limiting the arc of pivotal movement of the flapper valve.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Various companies make ball valve or flapper valve assemblies for mounting upon or attachment to the discharge pipe at the bottom of a toilet tank. Often, these assemblies define the discharge outlet and include a valve seat for cooperative engagement by the associated flapper valve. From time to time, the flapper valve must be replaced due to damage or general deterioration. A substantial after market exists for replacement flapper valves to be installed by either plumbers or homeowners. A company known in the trade as American Standard provides a flapper valve (sometimes referred to as a disc cylinder valve) assembly which does not permit use of the generally available after market replacement flapper valves. The primary inhibiting element is a pair of uprights extending from a location very close to the valve seat itself. These uprights tend to interfere with the after market flapper valves pivotally attached to an accompanying stand pipe. Accordingly, a specially configured flapper valve mated with the American Standard flapper valve assembly must be purchased for replacement purposes.

Figure 1:
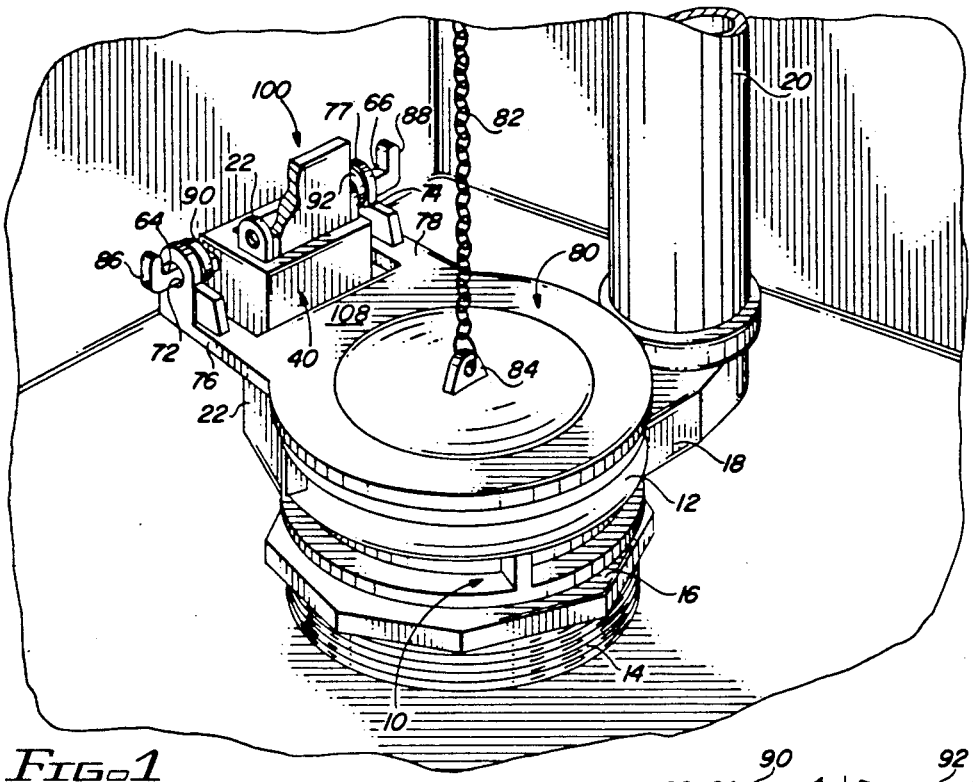
FIG. 1 is a perspective view illustrating the mounting of the adapter.
Figure 2:
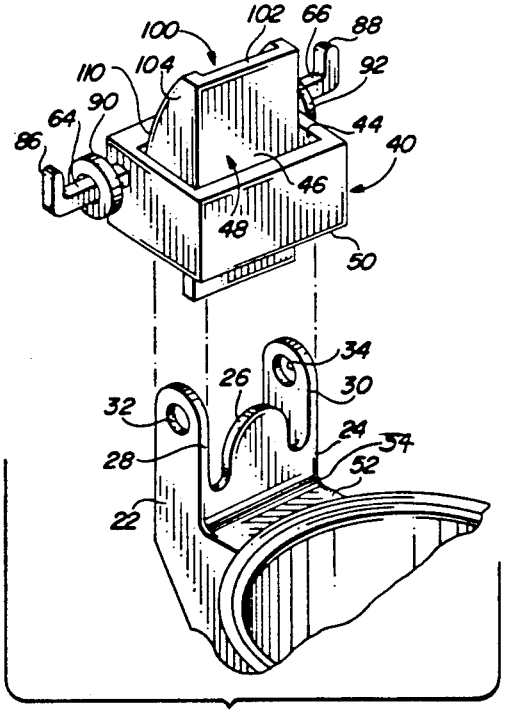
FIG. 2 is a partial isometric view illustrating the mounting of the adapter.

Referring to FIG. 1, there is shown a representative valve seat unit 10 manufactured by American Standard as part of its disc cylinder for the drain pipe in a toilet tank. A valve seat 12 includes a depending threaded conduit 14 for engaging the discharge pipe associated with the toilet tank. A nut 16, and other elements, are incorporated to effect robust mechanical attachment and a water tight seal. A housing 18 extends laterally from beneath the valve seat. It supports a conventionally operating stand pipe 20, which stand pipe is in fluid communication with the valve seat assembly downstream of the valve seat through housing 18. A pair of uprights 22,24 (see also FIG. 2) extend upwardly from a location adjacent valve seat 12. A web 26 interconnects front edge 28,30 of uprights 22,24, respectively. The top end of the web is disposed below the upper end of the uprights.

Figure 3:
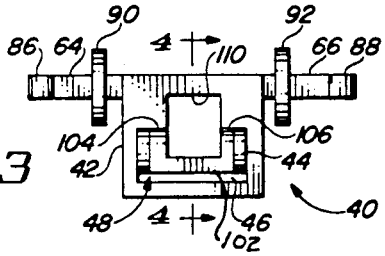
FIG. 3 is a top view of the adapter.
Figure 4:
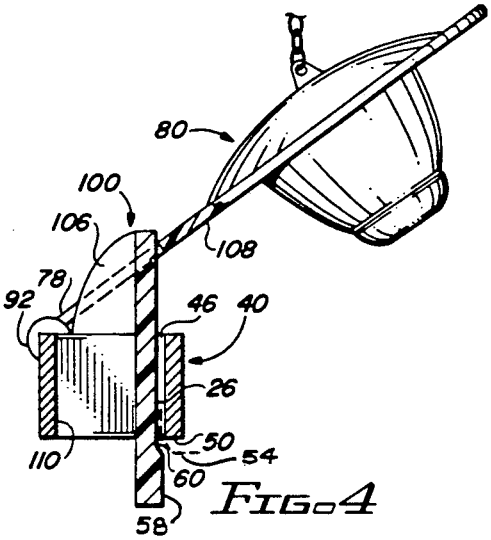
FIG. 4 is a partial cross sectional view showing the adapter and a part of a mounted flapper valve.

Adapter 40 is configured to penetrably receive uprights 22,24 and web 26 and through such engagement be positionally fixed with respect to valve seat unit 10 after the associated specially designed valve (not shown) has been removed. Further details attendant adapter 40 will be described with primary reference to FIGS. 2, 3 and 4. The adapter includes a first slot element 42 extending through the adapter for receiving upright 22. A second slot element 44 extends through the adapter for receiving upright 24. A third slot element 46 penetrably receives at least a portion of web 26. In the preferred embodiment, slot elements 42,44 and 46 define a U shaped passageway 48, as particularly illustrated in FIG. 3.

The vertical positioning of the adapter to place the pivotally attached flapper valve at the correct height and angular orientation with respect to valve seat 12 is controlled by forcing adapter 40 downwardly until bottom edge 50 bears against horizontal member 52 between uprights 22,24. As shown by dashed lines in FIG. 4, web 26 transitions to member 52 through a 90° arc segment 54. A brace 56 extends downwardly from adapter 40 from a location adjacent the lower opening defining third slot element 46. Front surface 58 of the brace includes a horizontally extending arced segment 60 curved to mate with the outer surface of arc segment 54. Accordingly, the lower end of the brace extends somewhat beneath horizontal member 52. The engagement of brace 56 with the horizontal member tends to restrain upward movement of the adapter and tends to maintain the adapter positionally locked in place.

Brace 56 also serves another purpose. In one of the configurations of the American Standard disc cylinder valve, horizontal member 52 is too low with respect to the valve seat to permit bottom edge 50 to rest thereagainst. To place adapter 40 at the correct height for operation of an attached flapper valve 62, reliance is placed upon the length of brace 56. In this particular American Standard disc cylinder valve, a shelf extends radially outwardly with respect to valve seat 12 from web 26 and between uprights 22,24. The position of this shelf is positionally fixed with respect to the valve seat and the shelf may be used as an index with respect to positioning the adapter. Upon mounting of the adapter upon the uprights and the web, the adapter is slid downwardly until further movement is precluded by interfering engagement between brace 56 and the shelf. Thus, by carefully setting the length of the brace, the mounted height of the adapter with respect to the valve seat can be set by either bottom edge 50 or brace 56.

Adapter 40 includes a pair of trunnions 64,66 extending from opposed sides 68,70. These trunnions penetrably engage apertures 72,74 of arms 76,78 extending from a replacement flapper valve 80. A chain or other coupling 82 is secured to the flapper valve via an ear 84 to permit raising of the flapper valve in the conventional manner to effect flushing. From this description it will become apparent that trunnions 64,66 pivotally mount flapper valve 80 and define the pivot axis for the flapper valve.

A pair of tabs 86,88 extend upwardly from the extremities of trunnions 64,66 respectively, to restrain disengagement of arms 76,78 of flapper valve 80 during normal use. A pair of flanges 90,92 which may be disc like, as shown, are mounted upon trunnions 64,66, respectively, to positionally retain arms 76,78 upon the trunnions.

A bracket 100 extends upwardly from the top surface of adapter 40 adjacent the interior sides of slot segments 42,44 and 46. This bracket may include a front side 102 and lateral sides 104,106. Preferably, lateral sides 104 and 106 taper upwardly toward front side 102. Under certain circumstances, it is possible for flapper valve 80 to be yanked hard enough to cause the flapper valve to pivot upwardly past vertical. Such pivotal movement will preclude reseating of the flapper valve upon valve seat 12. To prevent this from happening, bracket 100 extends upwardly a sufficient length to interferingly engage web 108 of the flapper valve, as particularly illustrated in FIG. 4. Such interfering engagement will preclude the flapper valve from pivoting upwardly past vertical. Thus, after drainage of water from within the toilet tank, the weight of the flapper valve will cause it to drop onto valve seat 12. It is to be understood that the configuration of bracket 100 may be modified while ensuring interfering engagement with some part of flapper valve 80 to retain the function and purpose of the bracket.

Preferably, adapter 40 is fabricated from flexible and resilient plastic or rubber like material to permit ease of mounting and gripping retention upon the pair of uprights. The configuration of the adapter is such that it may be formed as a monolithic unit. Thereby, it may be molded at relatively low per unit cost. During molding, shrinkage is usually a problem. A cavity or passageway 110 may be formed in the adapter to eliminate unnecessary material and to minimize shrinkage and deformation during cooling.

It may be noted that the height of uprights 22,24 and web 26 is irrelevant to mounting and use of adapter 40. That is, the adapter can be slid downwardly along the pair of uprights and the web to a location which provides proper and effective seating of flapper valve 80 upon valve seat 12. Thereby, even though valve seat units 10 of the type made by American Standard may have different length pairs of uprights, adapter 40 is capable of fitting all of them and will permit use of after market relatively inexpensive replacement flapper valves.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

We claim:

1. An adapter for pivotally mounting a flapper valve upon a pair of uprights having a web partly disposed between corresponding edges of the uprights, which uprights extend from a valve seat for a discharge pipe of a toilet tank, said adapter comprising in combination:

(a) a body having opposed sides;

(b) a pair of trunnions extending from opposed sides of said body for pivotally supporting a pair of apertured arms extending from the flapper valve;

(c) a passageway extending through said body for receiving and grippingly engaging the pair of uprights and at least a section of the web to mount and to retain said body with respect to the valve seat; and (d) means for limiting the upward pivotal movement of the flapper valve.

2. The adapter as set forth in claim 1 wherein said limiting means includes a bracket extending upwardly from said body for limiting the upward pivotal movement of the flapper valve.

3. The adapter as set forth in claim 1 wherein said passageway includes a passageway extending through said body for receiving the two uprights and at least a segment of the web.

4. The adapter as set forth in claim 3 wherein said passageway includes first and second slot elements configured in cross section to receive respective ones of the uprights and a third slot element interconnecting said first and second slot element for receiving the web.

5. The adapter as set forth in claim 4 including a brace depending from said body for interferingly engaging a section of the web between the uprights to restrain upward movement of said adapter.

6. The adapter as set forth in claim 5 wherein said brace depends from said body from a location adjacent an edge of said third slot element.

7. The adapter as set forth in claim 6 wherein said adapter is a monolithic unit.

8. The adapter as set forth in claim 4 wherein a shelf extends from the uprights and including a brace depending from said body to contact the shelf upon mounting of said adapter and thereby limit further downward movement of said adapter.

9. The adapter as set forth in claim 8 wherein said limiting means includes a bracket extending upwardly from said body for limiting the upward pivotal movement of the flapper valve.

10. An adapter for pivotally mounting a flapper valve upon a pair of uprights extending from a valve seat for a discharge pipe of a toilet tank and independent of a standpipe that may be associated with the toilet tank to accommodate upward pivotal movement of the flapper valve, said adapter comprising in combination:

(a) a body having opposed sides;

(b) a pair of trunnions extending from the opposed sides of said body for pivotally supporting a pair of apertured arms extending from the flapper valve;

(c) a passageway extending through said body for receiving and grippingly engaging the pair of uprights of the valve seat to mount and to retain said body on the pair of uprights, said passageway including at least first and second slot elements for penetrably receiving the uprights of the valve seat, each of said first and second slot elements having a cross section corresponding with the respective one of the pair of uprights;

(d) a web extending between the pair of uprights of the valve seat and wherein said passageway includes means of accommodating penetration of the web into the body; and (e) means for limiting the upward pivotal movement of the flapper valve.

11. The adapter as set forth in claim 10 wherein said first and second slot elements extend from opposed sides of said accommodating means.

12. The adapter as set forth in claim 10 wherein said accommodating means comprises a third slot element interconnecting with said first and second slot elements.

13. The adapter as set forth in claim 12 wherein said limiting means comprises a bracket extending upwardly from said body for interferingly engaging a part of the flapper valve to limit the degree of upward pivotal movement of the flapper valve.

14. The adapter as set forth in claim 13 wherein the flapper valve includes a web extending between the arms of the flapper valve and wherein said bracket includes means for interferingly contacting the web of the flapper valve.

15. The adapter as set forth in claim 14 wherein said adapter is a monolithic unit.

16. The adapter as set forth in claim 15 wherein said adapter is fabricated of flexible resilient material.

17. The adapter as set forth in claim 10 including a brace depending from said body for restraining removal of said adapter.

18. The adapter as set forth in claim 10 wherein said first and second slot elements comprise slots extending through said body.

19. The adapter as set forth in claim 10 including a brace for limiting the downward movement of said adapter along the uprights.

20. The adapter as set forth in claim 10 wherein said limiting means comprises a bracket extending upwardly from said body for interferingly engaging a part of the flapper valve to limit the degree of upward pivotal movement of the flapper valve.

* * * * *